US006619098B2

(12) United States Patent
Lisec

(10) Patent No.: US 6,619,098 B2
(45) Date of Patent: Sep. 16, 2003

(54) PROCESS AND DEVICE FOR BENDING OF HOLLOW PROFILE STRIPS INTO SPACER FRAMES FOR INSULATING GLASS PANES

(76) Inventor: Peter Lisec, Bahnhofstr. 34, Amstetten-Hausmening (AT), AT-3363

( * ) Notice: Subject to any disclaimer, the term of this patent is extended or adjusted under 35 U.S.C. 154(b) by 0 days.

(21) Appl. No.: 09/939,666

(22) Filed: Aug. 28, 2001

(65) Prior Publication Data

US 2003/0041641 A1 Mar. 6, 2003

(51) Int. Cl.[7] ..... B21D 9/05
(52) U.S. Cl. ..... 72/387; 72/411; 72/398
(58) Field of Search ..... 72/387, 217, 307, 72/411, 465.1, 466, 466.2, 378

(56) References Cited

U.S. PATENT DOCUMENTS

| | | | | | |
|---|---|---|---|---|---|
| 2,382,901 | A | * | 8/1945 | Newsome et al. | 72/115 |
| 4,916,929 | A | * | 4/1990 | Bihler | 72/203 |
| 5,794,481 | A | * | 8/1998 | Lisec | 72/307 |
| 6,023,956 | A | * | 2/2000 | Bayer | 72/217 |

FOREIGN PATENT DOCUMENTS

| | | | |
|---|---|---|---|
| DE | 198 39 444 | C1 | 1/2000 |
| DE | 198 39 444 | | 1/2000 |
| EP | 0 121 873 | A2 | 10/1984 |
| EP | 0 318 748 | A2 | 6/1989 |
| EP | 0 435 076 | A1 | 7/1991 |
| EP | 0 461 100 | A1 | 12/1991 |
| EP | 0 894 553 | A2 | 2/1999 |

* cited by examiner

*Primary Examiner*—Allen Ostrager
*Assistant Examiner*—John S Goetz
(74) *Attorney, Agent, or Firm*—Young & Thompson

(57) ABSTRACT

A bending head for bending of metallic hollow profile strips (2) in the production of spacer frames for insulating glass panes has a bending abutment (5) and a bending cheek (7). The bending abutment (5) can be placed by swivelling against one side of the section of the hollow profile strip (2) to be bent, conversely the bending cheek (7) can be placed from the outside against the hollow profile strip (2). In the execution of the bending process the bending abutment (5) and the bending cheek (7) are moved at the same time and hold the section of the hollow profile strip (2) to be bent between themselves.

20 Claims, 6 Drawing Sheets

PROCESS AND DEVICE FOR BENDING OF HOLLOW PROFILE STRIPS INTO SPACER FRAMES FOR INSULATING GLASS PANES

The invention relates to a process and a device with the features of the introductory part of the main process claim and the main apparatus claim.

Bending devices for hollow profile strips in order to bend spacer frames with corners made in one piece from them are known in different embodiments. For example, reference is made to EP 0 461 100 A (=U.S. Pat. No. 5,136,871A) and EP 0 318 748 A.

The object of the invention is to develop a device of the initially mentioned type ("bending head") such that with the bending device steel profiles (especially thin-walled steel profiles) can also be bent into spacer frames for insulating glass panes.

This object is achieved, with respect to the process, with the features of the main process claim, and with respect to the device, with the features of the main apparatus claim.

Preferred and advantageous embodiments of the process as claimed in the invention and the device as claimed in the invention are the subject matter of the dependent claims.

It is important for the success of the process as claimed in the invention and for the success of the device which is suitable especially for carrying out the process that the bending cheek delivered to the outside of the hollow profile strip during bending of the hollow profile strip adjoins the outside wall and the hollow profile strip is supported from the outside and that the bending abutment can be swivelled jointly with the bending cheek which adjoins from the outside. In one embodiment the bending process is advantageously supported by the bending cheek, when bending the hollow profile strip, moving along the latter, away from the bending site, while it adjoins the outside surface of the hollow profile strip.

The manner of operation as claimed in the invention and the device provided as claimed in the invention make it possible to bend these hollow profile strips in which the side flanks project over the inside wall of the hollow profile strip without the projecting side walls being creased after the bending process.

Other details, features and advantages of the invention result from the following description of the manner of operation and the construction of one preferred embodiment of the device as claimed in the invention (bending head).

FIG. 1 schematically shows the important parts of the bending head as claimed in the invention in the initial position;

Figure 3:
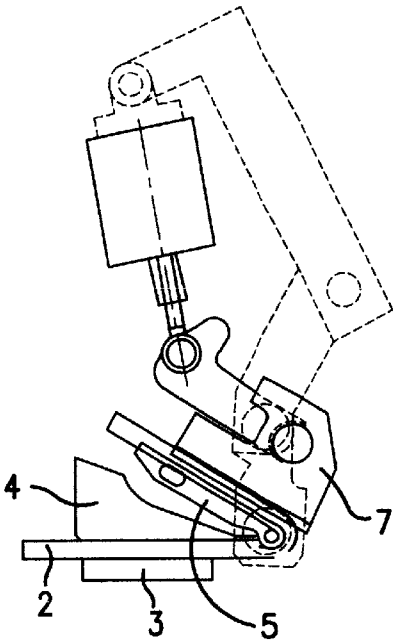
FIG. 3 shows the position of the bending head after bending a hollow profile strip by more than 90°.

The important parts of the bending head 1 shown schematically in FIGS. 1 to 4 are the lower guide 3 which is stationary in the bending process, the top guide cheek 4, two side support jaws 14, 15 for the hollow profile strip 2 to be bent, the bending abutment 5 which can be swivelled around an axis 6, and the bending cheek 7 which is located on a lever 8 which can be swivelled around the same axis 6 as the bending abutment 5.

The distance of the guide 3 from the guide cheek 4 can for example be matched to the dimensions (height) of the hollow profile strip 2 by adjusting the upper guide cheek 4.

Figure 1:
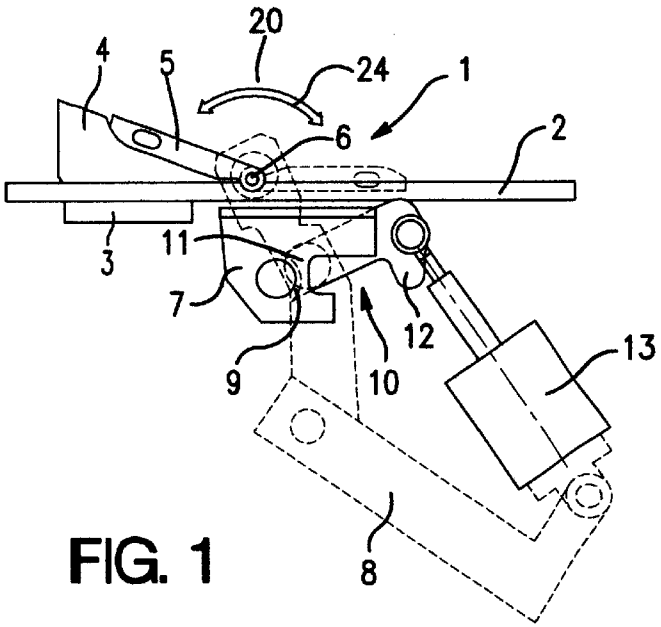

To deliver the bending cheek 7 to the outer side of the hollow profile strip 2 which is the lower side in FIG. 1, the bending cheek 7 is supported on one arm 9 of a twin-arm lever 10 which is supported to be able to swivel around an axis 11 on the lever 8. A hydraulic cylinder 13 engages the other arm 12 of the twin-arm lever 10 and swivels the twin-arm lever 10 such that the (lower) bending cheek 7 is placed underneath against the outside of the hollow profile strip 2 to be bent. Preferably the axis 6 and the axis around which the bending cheek 7 is supported on the twin-arm lever 10 in the initial position shown in FIG. 1 lie essentially in the plane which is perpendicular to the hollow profile strip 2.

Figure 9:
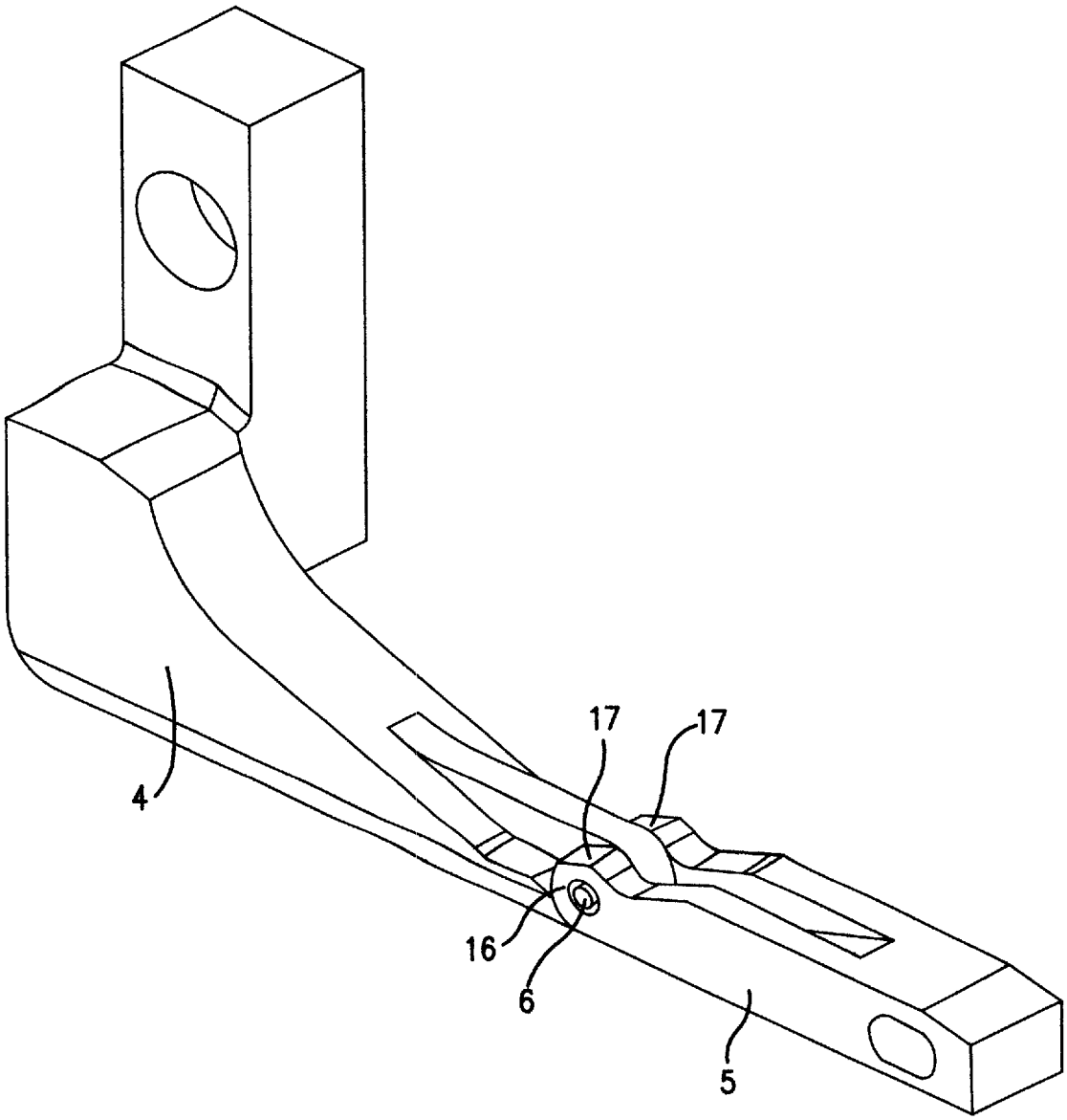
FIG. 9 shows the upper guide cheek with the bending abutment.

The bending abutment 5 (see also FIG. 9) on its front head 16 which faces the hollow profile strip 2 has a flattened area 17 which faces the inside (pointing up in FIG. 1) wall of the hollow profile strip 2 in the position of the bending abutment 5 from FIG. 1 and preferably adjoins it. When the bending abutment 5 is swivelled into the position shown by the dotted line in FIG. 1 the head 16 of the bending abutment 5 presses the inside wall of the hollow profile strip 2 to the inside in areas so that the bending process is facilitated. As is shown in FIG. 9, the bending abutment 5 can be supported to be able to swivel around the axis 6 on the upper guide cheek 4.

In the embodiment shown in FIGS. 1 to 4, the hollow profile strip 2 is made of sheet steel, the side walls of the hollow profile strip 2 projecting over the inside wall of the hollow profile strip 2.

Figure 4:
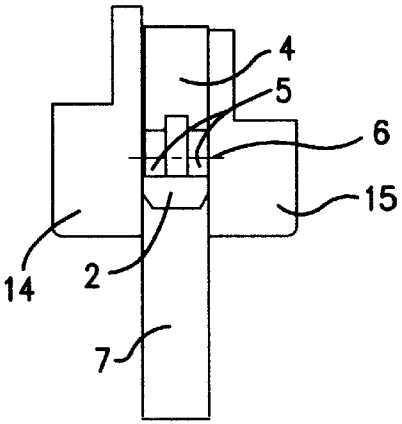
FIG. 4 shows the bending abutment, the bending cheek and the side guide and holding jaws in a view from the right of FIG. 1.

To bend the hollow profile strip 2, by actuating the hydraulic cylinder 13 first the bending cheek 7 is placed against the outside (pointing down) of the hollow profile strip 2 and accommodates it, as shown in FIG. 4, preferably in a surface which is contoured according to the outside of the hollow profile strip 2, so that the outside of the hollow profile strip 2 in the bending process is well supported. Then the bending abutment 5 is swivelled out of the position shown by the solid lines in FIG. 1 into the position shown by the dotted line in FIG. 1 (arrow 24), and the inside wall of the hollow profile strip 2 can be deformed in areas to the inside by the head 16 of the bending abutment 5. The bending abutment 5 including its head 16 can have a width which is such that the bending abutment 5 is accommodated between the side walls of the hollow profile strip 2 which project over the inside wall and supports the side walls in the bending area, especially during the actual bending process (compare FIG. 4).

Figure 2:
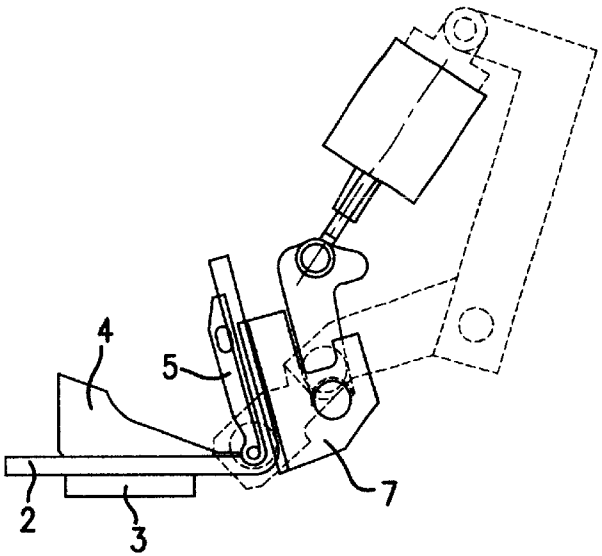
FIG. 2 shows the position of the bending head after bending a hollow profile strip by roughly 90°.

When the hollow profile strip 2 is located between the bending cheek 7 on the one hand and the bending abutment 5 on the other, the swivelling lever 8 and thus the bending cheek 7 and synchronously to it the bending abutment 5 are swivelled around the axis 6 until the end of the hollow profile strip 2 which projects over the bending site (symbolized by the arrow 20 in FIG. 1) includes the desired angle with the other part of the hollow profile strip 2. This angle can be of any magnitude and for example can be 90° or an obtuse or acute angle, as is shown in FIGS. 2 and 3.

After the bending process has been ended, the swivelling lever 8 with the bending cheek 7 and the bending abutment 5 is swivelled back into the position shown in FIG. 1. Hereupon the hollow profile strip 2 is advanced until the next position in which one corner can be produced by bending the hollow profile strip 2 is aligned in the bending position (arrow 20).

Figure 5:
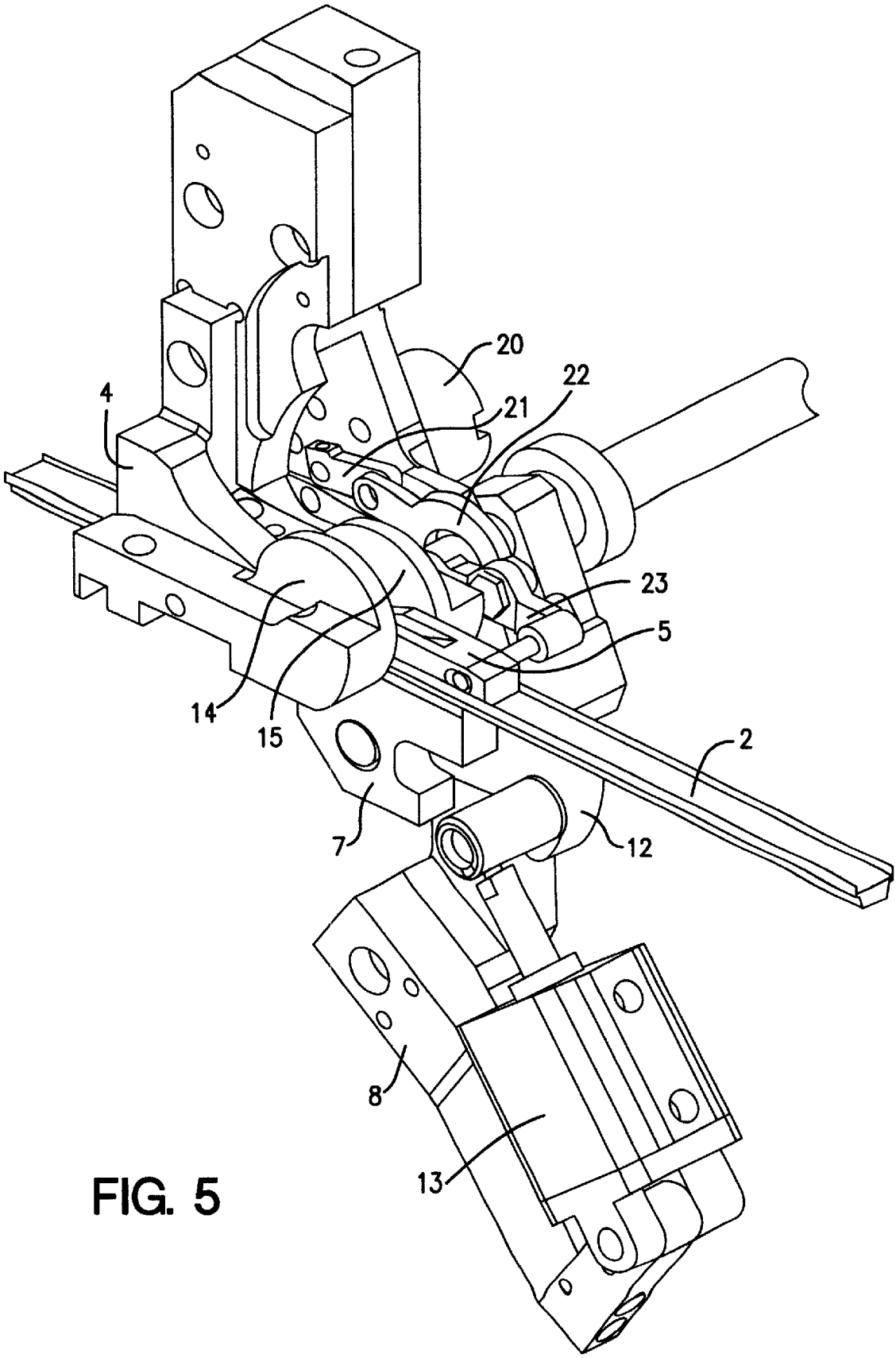
FIG. 5 shows the bending head in the initial position in an oblique view.
Figure 6:
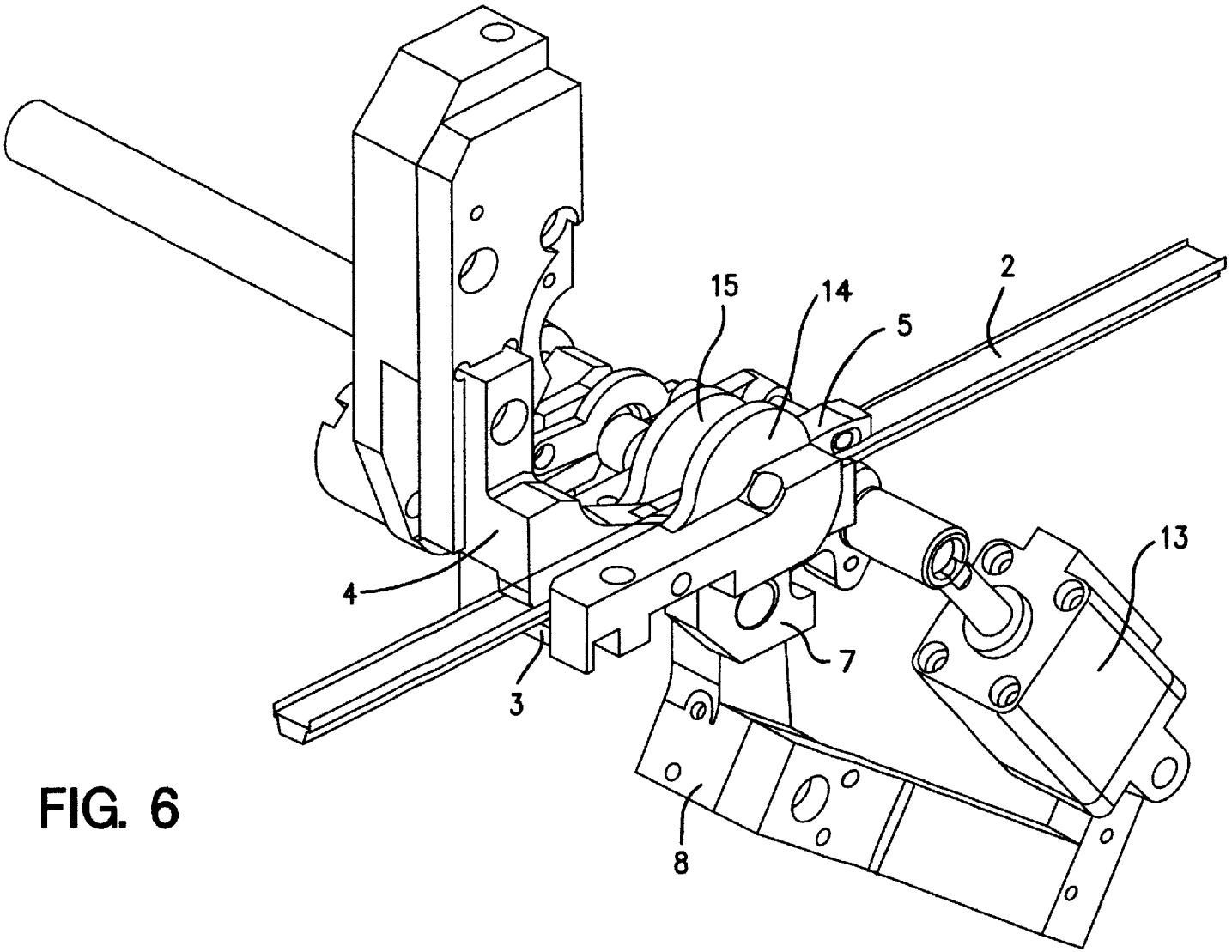
FIG. 6 shows the bending head in the position as shown in FIG. 5 in another oblique view.

The jaws 14 and 15 which are shown in FIG. 4 and between which the side walls of the hollow profile strip 2 are held and guided are shown in FIGS. 5 and 6 in more detail. One of the two jaws (in the embodiment shown the jaw 14) is adjustable in order to be able to match the bending head 1 to hollow profile strips 2 of varied width and in order to move the jaws 14, 15 away from one another between the individual bending processes so that the advance of the hollow profile strip 2 is simplified.

FIGS. 5 and 6 show the bending abutment 5 in its action position (shown by the broken line in FIG. 1). To swivel the bending abutment 5, for example, for swivelling into the positions of FIGS. 2, 3, 7 or 8, there is a torque motor 20 which drives a swivelling lever 21 which, via a coupling arm 22, engages with a lever 23 which can be swivelled around the axis 6 so that the bending abutments 5 can be swivelled in the direction of the double arrow 24 in FIG. 1 with a drive made in the manner of a parallelogram drive.

The swivelling axis 6 of the lever 8 on which the bending cheek 7 is located is the same axis around which the bending abutment 5 can be swivelled so that it is at the same time the axis around which the hollow profile strip 2 is swivelled.

It is shown in FIGS. 5 and 6 that the bending head 1 as claimed in the invention is suited among others also for bending hollow profile strips 2 with side walls which project over the inside wall of the hollow profile strip 2, as is often the case for example in hollow profile strips of steel sheet.

Figure 7:
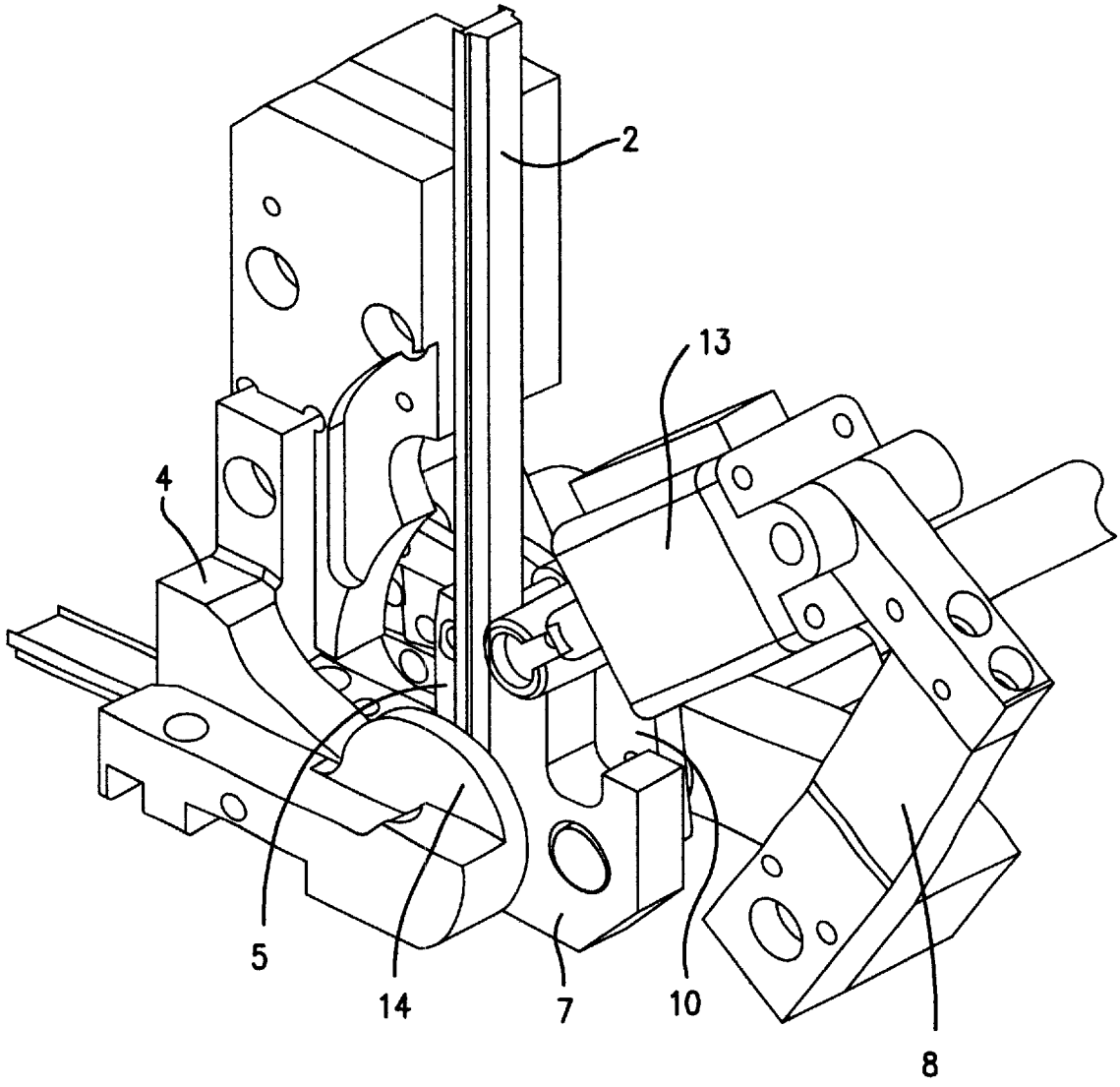
FIG. 7 shows the bending head after bending a hollow profile strip by 90° in an oblique view.
Figure 8:
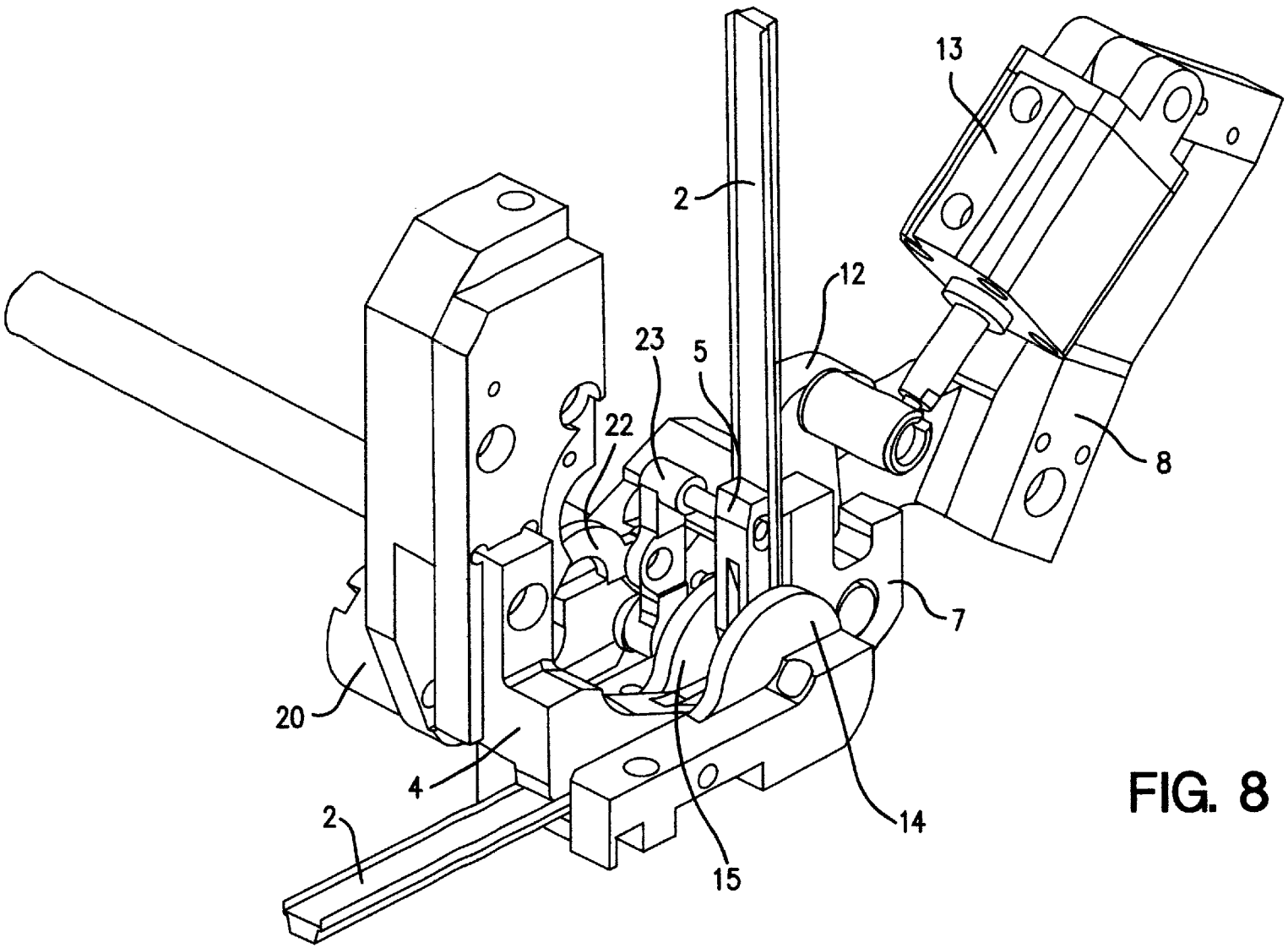
FIG. 8 shows the bending head in the position shown in FIG. 7 in another oblique view.

FIGS. 7 and 8 show the bending head from FIGS. 5 and 6 in its position after bending of a hollow profile strip by 90°.

The guide cheek 4 which fits between the side walls which project upward in the embodiment shown and which engages the hollow profile strip 2 from overhead is easily interchangeable together with the bending abutment 5 which is supported on it after opening the jaws 14, 15 in order to be able to match the bending head 1 to other widths of hollow profile strips. Feasibly the bending cheek 7 can also be easily replaced by one with a different width or profiling.

In summary, one preferred embodiment of the invention can be described as follows:

A bending head 1 for bending of metallic hollow profile strips 2 in the production of spacer frames for insulating glass panes has a bending abutment 5 and a bending cheek 7. The bending abutment 5 can be placed by swivelling against one side of the section of the hollow profile strip 2 to be bent, conversely the bending cheek 7 can be placed from the outside against the hollow profile strip 2. In the execution of the bending process the bending abutment 5 and the bending cheek 7 are moved at the same time and hold the section of the hollow profile strip 2 to be bent between themselves.

What is claimed is:

1. A device for bending hollow section strips toward an inside wall of the hollow section strips to produce spacer frames for insulating glass panes, comprising:

jaws (14, 15) positioned along side walls of the hollow section strip (2);

a bending lever (8) pivotable about an axis;

a bending cheek (7) attached to the bending lever and positioned along an outside wall of the hollow section strip (2) to apply a bending force to the hollow section strip;

a pivotable bending block (5) having a rounded front end, positioned along the inside wall of the hollow section strip and pivotable about the axis of the bending lever, independent of the bending lever, so that the bending block is initially positioned against a fixed portion of the hollow section strip prior to application of the bending force, and so that the bending block is pivoted from the initial position to a bending position against a portion of the hollow section strip to which the bending force is applied, opposite the bending cheek, the bending block having a flattened portion that is aligned in the initial position of the bending block (5) to be parallel to the hollow section strip (2) and placed against the hollow section strip (2).

2. Device as claimed in claim 1, wherein the bending cheek (7) is adjustably located on the bending lever (8).

3. Device as claimed in claim 2, wherein the bending cheek (7) is located on one arm (9) of a two-arm lever (10) which is supported on the bending lever (8), another arm (12) of the two-arm lever being engaged by a linear motor (13) which is supported on the bending lever (8).

4. Device as claimed in claim 1, wherein a side of the bending cheek (7) facing the hollow section strip (2) has a contour that corresponds to a shape of the outside wall of the hollow section strip (2).

5. Device as claimed in claim 1, wherein the bending block (5) is pivotally supported on a guide cheek (4) that adjoins the hollow section strip (2) along a top of the hollow section strip.

6. Device as claimed in claim 5, wherein the guide cheek (4) with the bending block (5) is interchangeably attached to a bending head (1).

7. Device as claimed in claim 1, wherein the bending cheek (7) is interchangeably attached to the bending lever (8).

8. Device as claimed in claim 5, wherein the guide cheek (4) and the bending block (5) have a width that is less than a width of the hollow section strip (2).

9. Device as claimed in claim 5 wherein the guide cheek (4) and the bending block (5) have a width that is as great as a clearance of two sections of the side walls of the hollow section strip (2), which sections project over an inside wall of the hollow section strip (2).

10. Device as claimed in claim 2, wherein a side of the bending cheek (7) facing the hollow section strip (2) has a contour that corresponds to a shape of the outside wall of the hollow section strip (2).

11. Device as claimed in claim 3 wherein a side of the bending cheek (7) facing the hollow section strip (2) has a contour that corresponds to a shape of the outside wall of the hollow section strip (2).

12. Device as claimed in claim 2 wherein the bending block (5) is pivotally supported on a guide cheek (4) that adjoins the hollow section strip (2) along a top of the hollow section strip.

13. Device as claimed in claim 4, wherein the bending block (5) is pivotally supported on a guide cheek (4) that adjoins the hollow section strip (2) along a top of the hollow section strip.

14. Device as claimed in claim 4, wherein the bending block (5) is pivotally supported on a guide cheek (4) that adjoins the hollow section strip (2) along a top of the hollow section strip.

15. Device as claimed in claim 2, wherein the bending cheek (7) is interchangeably attached to the bending lever (8).

16. Device as claimed in claim 3, wherein the bending cheek (7) is interchangeably attached to the bending lever (8).

17. Device as claimed in claim 4, wherein the bending cheek (7) is interchangeably attached to the bending lever (8).

18. Device as claimed in claim 5, wherein the bending cheek (7) is interchangeably attached to the bending lever (8).

19. Device as claimed in claim 6, wherein the bending cheek (7) is interchangeably attached to the bending lever (8).

20. A process for bending hollow section strips in production of spacer frames for insulating glass panes in which a hollow section strip is bent around a stationary point, comprising the steps of:

providing a guide and a guide cheek arranged along opposite sides of a fixed portion of the hollow section strip;

providing a movable bending lever arranged along an outside of a portion of the hollow section strip to be bent;

providing a pivotable bending block arranged along an inside of the hollow section strip;

placing the hollow section strip between the guide and the guide cheek, with the pivotable bending block in a first position along the fixed portion of the hollow section strip;

pivoting the bending block to a second position so that the bending block is positioned against a portion of the hollow section strip that is to be bent;

moving both the bending lever and the bending block so that a bending force is applied to the portion of the hollow section strip that is to be bent.

* * * * *